US009073683B2

(12) United States Patent
Holley, Jr. et al.

(10) Patent No.: US 9,073,683 B2
(45) Date of Patent: Jul. 7, 2015

(54) CARTON WITH ARTICLE PROTECTION FLAP

(71) Applicant: Graphic Packaging International, Inc., Atlanta, GA (US)

(72) Inventors: John Murdick Holley, Jr., Lawrenceville, GA (US); Mark Baldino, Marietta, GA (US); Raymond S. Kastanek, Kennesaw, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 142 days.

(21) Appl. No.: 13/799,608

(22) Filed: Mar. 13, 2013

(65) Prior Publication Data

US 2014/0021081 A1 Jan. 23, 2014

Related U.S. Application Data

(60) Provisional application No. 61/741,315, filed on Jul. 17, 2012.

(51) Int. Cl.
*B65D 5/485* (2006.01)
*B65D 71/40* (2006.01)
(Continued)

(52) U.S. Cl.
CPC ..... *B65D 71/403* (2013.01); *B65B 5/024* (2013.01); *B65B 5/10* (2013.01); *B65D 5/42* (2013.01); *B65D 5/4608* (2013.01);
(Continued)

(58) Field of Classification Search
CPC ..... B65D 71/0022; B65D 5/54; B65D 5/32; B65D 5/48; B65D 2571/00314; B65D 2571/00253; B65D 2571/00259; B65D 2571/0029; B65D 2571/0066
USPC ..... 206/427, 148, 156, 145, 153, 147, 152, 206/168, 194–199; 229/117.3, 117.16, 229/103.2, 103.3; 294/87.2
See application file for complete search history.

(56) References Cited

U.S. PATENT DOCUMENTS 1,925,102 A 9/1933 Levkoff
2,005,924 A 6/1935 Wilson
(Continued)

FOREIGN PATENT DOCUMENTS

CA 873185 6/1971
EP 0 024 782 A1 3/1981
(Continued)

OTHER PUBLICATIONS

International Search Report and Written Opinion for PCT/US2013/030773 dated Jun. 21, 2013.

*Primary Examiner* — Mickey Yu
*Assistant Examiner* — Gideon Weinerth
(74) *Attorney, Agent, or Firm* — Womble Carlyle Sandridge & Rice, LLP

(57) ABSTRACT

A carton for containing at least one article. The carton comprises a plurality of panels at least partially forming an interior of the carton. The plurality of panels comprises a top panel. The carton comprises an article protection flap foldably connected to at least one panel of the plurality of panels. The article protection flap is moveable between a first position that is substantially parallel to the top panel and a second position wherein the article protection flap is folded relative to the top panel. The at least one access feature in the top panel is for positioning the article protection flap from the first position to the second position.

35 Claims, 10 Drawing Sheets

(51) Int. Cl.

| | |
|---|---|
| ***B65B 5/02*** | (2006.01) |
| ***B65B 5/10*** | (2006.01) |
| ***B65D 5/42*** | (2006.01) |
| ***B65D 5/468*** | (2006.01) |
| ***B65D 5/50*** | (2006.01) |
| ***B65D 85/20*** | (2006.01) |
| ***B65D 71/36*** | (2006.01) |

(52) U.S. Cl.

CPC ..... *B65D 5/5026* (2013.01); *B65D 85/20* (2013.01); *B65D 71/36* (2013.01); *B65D 2571/00141* (2013.01); *B65D 2571/00265* (2013.01); *B65D 2571/0032* (2013.01); *B65D 2571/0045* (2013.01); *B65D 2571/00574* (2013.01); *B65D 2571/0066* (2013.01); *B65D 2571/00728* (2013.01)

(56) References Cited

U.S. PATENT DOCUMENTS

| | | | | | |
|---|---|---|---|---|---|
| 2,067,749 | A | | 1/1937 | Zimmerman et al. | |
| 2,115,673 | A | | 4/1938 | Stompe | |
| 2,196,502 | A | | 4/1940 | Kells | |
| 2,225,822 | A | * | 12/1940 | Crook | 206/168 |
| 2,299,027 | A | | 10/1942 | Novak | |
| 2,386,905 | A | | 10/1945 | Meitzen | |
| 2,505,399 | A | * | 4/1950 | Hilton | 206/756 |
| 2,648,484 | A | | 8/1953 | Belsinger | |
| 2,669,351 | A | | 2/1954 | Carson et al. | |
| 2,754,047 | A | | 7/1956 | Schmidt et al. | |
| 2,877,894 | A | | 3/1959 | Forrer | |
| 2,950,041 | A | * | 8/1960 | Stone | 206/147 |
| 3,078,032 | A | | 2/1963 | Robinson et al. | |
| 3,128,010 | A | | 4/1964 | Forrer | |
| 3,133,634 | A | | 5/1964 | Bozdar | |
| 3,152,688 | A | | 10/1964 | Mahon | |
| 3,167,214 | A | | 1/1965 | Mahon | |
| 3,173,596 | A | | 3/1965 | Aust et al. | |
| 3,176,902 | A | | 4/1965 | Champlin | |
| 3,178,242 | A | | 4/1965 | Ellis et al. | |
| 3,228,582 | A | | 1/1966 | Osberg | |
| 3,252,649 | A | | 5/1966 | Graser et al. | |
| 3,255,919 | A | | 6/1966 | Koolnis | |
| 3,263,861 | A | | 8/1966 | Carr | |
| 3,265,283 | A | | 8/1966 | Farquhar | |
| 3,300,115 | A | | 1/1967 | Schauer | |
| 3,332,594 | A | | 7/1967 | De Capua | |
| 3,346,167 | A | | 10/1967 | Schmidt | |
| 3,355,012 | A | | 11/1967 | Weiss | |
| 3,356,279 | A | | 12/1967 | Root | |
| 3,367,557 | A | | 2/1968 | Farquhar | |
| 3,386,570 | A | | 6/1968 | Lock | |
| 3,424,302 | A | * | 1/1969 | Ganz | 206/152 |
| 3,432,029 | A | | 3/1969 | Brown | |
| 3,517,858 | A | | 6/1970 | Farquhar | |
| 3,533,549 | A | | 10/1970 | Gilchrist | |
| 3,540,581 | A | | 11/1970 | Koolnis | |
| 3,669,342 | A | | 6/1972 | Funkhouser | |
| 3,670,950 | A | | 6/1972 | Rossi | |
| 3,674,137 | A | * | 7/1972 | Graser | 206/158 |
| 3,679,121 | A | | 7/1972 | Morgese | |
| 3,687,282 | A | | 8/1972 | Owen | |
| 3,711,143 | A | * | 1/1973 | Smed | 294/87.2 |
| 3,715,029 | A | | 2/1973 | Wood | |
| 3,747,801 | A | | 7/1973 | Graser | |
| 3,750,874 | A | * | 8/1973 | Detzel et al. | 206/141 |
| 3,767,042 | A | | 10/1973 | Ganz | |
| 3,797,729 | A | | 3/1974 | Holmes | |
| 3,825,170 | A | | 7/1974 | Aust et al. | |
| 3,904,036 | A | | 9/1975 | Forrer | |
| 3,921,895 | A | | 11/1975 | Ziche | |
| 3,942,631 | A | | 3/1976 | Sutherland et al. | |
| 3,963,121 | A | | 6/1976 | Kipp | |
| 3,977,518 | A | | 8/1976 | Arneson | |
| 4,034,852 | A | | 7/1977 | Forrer | |
| 4,056,223 | A | | 11/1977 | Williams | |
| 4,093,068 | A | | 6/1978 | Smrt | |
| 4,101,069 | A | | 7/1978 | Wood | |
| 4,131,230 | A | * | 12/1978 | Koehlinger et al. | 206/155 |
| 4,146,168 | A | | 3/1979 | Hartline | |
| 4,155,449 | A | | 5/1979 | Bryne | |
| 4,186,867 | A | | 2/1980 | Wood | |
| 4,197,941 | A | * | 4/1980 | Halasz | 206/216 |
| 4,202,446 | A | | 5/1980 | Sutherland | |
| 4,214,660 | A | | 7/1980 | Hunt, Jr. | |
| 4,222,485 | A | | 9/1980 | Focke | |
| 4,256,226 | A | | 3/1981 | Stone | |
| 4,295,562 | A | | 10/1981 | Wood | |
| 4,318,474 | A | | 3/1982 | Hasegawa | |
| 4,324,328 | A | | 4/1982 | Champlin | |
| 4,328,891 | A | | 5/1982 | Elward | |
| 4,328,922 | A | | 5/1982 | Hirata | |
| 4,330,079 | A | | 5/1982 | Wood | |
| 4,364,509 | A | | 12/1982 | Holley, Jr. et al. | |
| 4,375,258 | A | | 3/1983 | Crayne et al. | |
| 4,376,509 | A | | 3/1983 | Schaffer | |
| 4,378,877 | A | | 4/1983 | Botterman et al. | |
| 4,383,612 | A | | 5/1983 | Pawlowski | |
| 4,394,903 | A | * | 7/1983 | Bakx | 206/427 |
| 4,396,143 | A | | 8/1983 | Killy | |
| 4,398,631 | A | | 8/1983 | Graser | |
| 4,417,655 | A | | 11/1983 | Forbes, Jr. | |
| 4,417,661 | A | | 11/1983 | Roccaforte | |
| 4,421,232 | A | | 12/1983 | Konaka | |
| 4,424,901 | A | | 1/1984 | Lanier | |
| 4,437,569 | A | | 3/1984 | Sorenson | |
| 4,437,606 | A | | 3/1984 | Graser | |
| 4,438,843 | A | | 3/1984 | Graser | |
| 4,463,852 | A | | 8/1984 | Stone | |
| 4,465,180 | A | | 8/1984 | Klygis | |
| 4,470,503 | A | | 9/1984 | Stone | |
| 4,498,618 | A | | 2/1985 | Sutherland | |
| 4,505,696 | A | | 3/1985 | Wright et al. | |
| 4,533,047 | A | | 8/1985 | Calvert | |
| 4,538,759 | A | | 9/1985 | Dutcher | |
| 4,545,485 | A | | 10/1985 | Oliff | |
| 4,574,997 | A | | 3/1986 | Ikeda | |
| 4,577,762 | A | | 3/1986 | Kuchenbecker | |
| 4,588,084 | A | | 5/1986 | Holley, Jr. | |
| 4,597,523 | A | | 7/1986 | Schuster | |
| 4,600,140 | A | | 7/1986 | Milliens | |
| 4,605,128 | A | | 8/1986 | Rieke | |
| 4,621,766 | A | | 11/1986 | McClure | |
| 4,658,984 | A | | 4/1987 | Brunner | |
| 4,708,284 | A | | 11/1987 | Sutherland et al. | |
| 4,757,938 | A | | 7/1988 | Collins | |
| 4,773,533 | A | | 9/1988 | Greene | |
| 4,817,866 | A | | 4/1989 | Wonnacott | |
| 4,830,267 | A | | 5/1989 | Wilson | |
| 4,836,375 | A | | 6/1989 | Schuster et al. | |
| 4,883,168 | A | | 11/1989 | Dreyfus | |
| 4,890,440 | A | | 1/1990 | Romagnoli | |
| 4,890,737 | A | | 1/1990 | Kadleck et al. | |
| 4,890,738 | A | | 1/1990 | Carer | |
| 4,919,266 | A | | 4/1990 | McIntosh, Jr. et al. | |
| 4,925,019 | A | | 5/1990 | Ganz et al. | |
| 4,949,845 | A | | 8/1990 | Dixon | |
| 4,967,901 | A | | 11/1990 | Wood | |
| 4,974,771 | A | | 12/1990 | Lavery | |
| 5,002,186 | A | | 3/1991 | Cooper | |
| D316,672 | S | | 5/1991 | Wood | |
| 5,020,668 | A | | 6/1991 | Schuster | |
| 5,022,525 | A | | 6/1991 | Schuster | |
| 5,072,876 | A | | 12/1991 | Wilson | |
| 5,080,280 | A | | 1/1992 | Kraus | |
| 5,101,642 | A | | 4/1992 | Alexandrov | |
| 5,119,985 | A | | 6/1992 | Dawson et al. | |
| 5,131,588 | A | | 7/1992 | Oliff | |
| 5,137,211 | A | | 8/1992 | Summer et al. | |
| 5,145,067 | A | | 9/1992 | Carver | |
| 5,158,177 | A | | 10/1992 | Negelen et al. | |
| 5,167,325 | A | | 12/1992 | Sykora | |
| 5,219,229 | A | | 6/1993 | Sengewald | |

(56) References Cited

U.S. PATENT DOCUMENTS 5,234,103 A * 8/1993 Schuster ..... 206/158
5,246,112 A 9/1993 Stout et al.
5,249,681 A 10/1993 Miller
5,297,673 A 3/1994 Sutherland
5,297,725 A 3/1994 Sutherland
5,310,050 A 5/1994 Sutherland
5,311,984 A 5/1994 Harris
5,320,277 A 6/1994 Stout et al.
5,328,080 A 7/1994 Holley, Jr.
5,333,734 A 8/1994 Stout et al.
5,350,109 A 9/1994 Brown et al.
5,360,104 A 11/1994 Sutherland
5,360,113 A 11/1994 Harris
5,385,234 A 1/1995 Stout et al.
5,390,784 A 2/1995 Sutherland
5,390,848 A 2/1995 Gungner et al.
5,425,474 A 6/1995 Dalea et al.
5,437,363 A 8/1995 Gungner
5,439,112 A 8/1995 De Guglielmo et al.
5,443,203 A 8/1995 Sutherland
5,472,090 A 12/1995 Sutherland
5,476,217 A 12/1995 Moncrief et al.
5,482,185 A 1/1996 McNaughton
5,482,203 A 1/1996 Stout
5,505,372 A 4/1996 Edson et al.
5,549,197 A 8/1996 Sutherland
5,577,612 A 11/1996 Chesson et al.
5,579,904 A 12/1996 Holley, Jr.
5,582,289 A 12/1996 Wright
5,588,585 A 12/1996 McClure
5,595,291 A 1/1997 Negelen
5,595,292 A 1/1997 Bates
5,595,299 A 1/1997 LeBras
5,597,114 A 1/1997 Kramedjian et al.
5,605,228 A 2/1997 Baxter
5,622,309 A 4/1997 Matsuda et al.
5,653,340 A 8/1997 Daniel
5,664,683 A 9/1997 Brody
5,671,845 A 9/1997 Harris
5,690,213 A 11/1997 Matsumura
5,690,230 A 11/1997 Griffith
5,699,957 A 12/1997 Blin et al.
5,765,685 A 6/1998 Roosa
5,775,572 A 7/1998 Oliff
5,794,778 A 8/1998 Harris
5,826,783 A 10/1998 Stout
5,873,516 A 2/1999 Boggs
5,875,961 A 3/1999 Stone et al.
5,881,884 A 3/1999 Podosek
5,921,398 A 7/1999 Carroll
5,924,559 A 7/1999 Carrel et al.
5,927,498 A 7/1999 Saam
5,941,389 A 8/1999 Gomes
5,947,367 A 9/1999 Miller et al.
5,975,286 A 11/1999 Oliff
5,975,287 A 11/1999 Negelen
5,979,645 A 11/1999 Holley, Jr.
5,984,086 A 11/1999 Fousghee et al.
6,050,402 A 4/2000 Walter
6,155,412 A 12/2000 LeBras et al.
6,170,741 B1 1/2001 Skolik et al.
6,176,419 B1 1/2001 Holley, Jr.
6,189,687 B1 2/2001 Bakx
6,213,297 B1 4/2001 Gale
6,241,083 B1 6/2001 Harrelson
6,247,585 B1 6/2001 Holley, Jr.
6,250,542 B1 6/2001 Negelen
6,273,330 B1 8/2001 Oliff et al.
6,283,293 B1 9/2001 Lingamfelter
6,295,789 B1 10/2001 Muller
6,302,320 B1 10/2001 Stout
6,315,111 B1 11/2001 Sutherland
6,315,123 B1 11/2001 Ikeda
6,409,077 B1 6/2002 Telesca et al.
D459,927 S 7/2002 Flowers et al.
6,471,120 B1 10/2002 Vogel
6,478,219 B1 11/2002 Holley, Jr.
6,484,903 B2 11/2002 Spivey et al.
6,527,108 B1 * 3/2003 Blin et al. ..... 206/148
6,536,656 B2 3/2003 Auclair et al.
6,550,615 B2 4/2003 Lingamfelter
6,557,699 B1 5/2003 Focke et al.
6,578,736 B2 6/2003 Spivey
6,604,677 B1 8/2003 Sutherland et al.
6,615,984 B2 9/2003 Saulas et al.
6,631,803 B2 10/2003 Rhodes et al.
6,669,083 B2 12/2003 Bates
6,695,137 B2 2/2004 Jones et al.
6,715,639 B2 4/2004 Spivey
6,752,262 B1 6/2004 Boriani et al.
6,789,673 B2 9/2004 Lingamfelter
6,848,573 B2 2/2005 Gould et al.
6,866,186 B2 3/2005 Fogle et al.
6,877,600 B2 4/2005 Sutherland
6,896,130 B2 5/2005 Theelen
6,902,104 B2 6/2005 Holley, Jr. et al.
6,918,487 B2 7/2005 Harrelson
6,926,193 B2 8/2005 Smalley
6,929,172 B2 8/2005 Bates et al.
6,932,265 B2 8/2005 Sax et al.
6,948,293 B1 9/2005 Eckermann et al.
6,968,992 B2 11/2005 Schuster
6,974,072 B2 12/2005 Harrelson
6,983,874 B2 1/2006 Bakx
6,991,107 B2 1/2006 Harrelson
6,997,316 B2 2/2006 Sutherland
6,997,372 B2 2/2006 Gasparowicz
7,000,803 B2 2/2006 Miller
7,028,839 B2 4/2006 Belloli et al.
7,048,113 B2 5/2006 Gomes
7,063,208 B2 6/2006 Lebras
7,070,045 B2 7/2006 Theelen
7,073,665 B2 7/2006 Auclair et al.
7,104,435 B2 9/2006 Holley, Jr.
7,134,547 B2 11/2006 Auclair
7,134,593 B2 11/2006 Harrelson
7,159,759 B2 1/2007 Sutherland
7,175,020 B2 2/2007 Sutherland et al.
7,225,930 B2 6/2007 Ford et al.
7,234,591 B2 6/2007 LeBras et al.
7,374,038 B2 5/2008 Smalley
7,422,104 B2 9/2008 Perkinson
7,427,010 B2 9/2008 Sutherland
7,467,729 B2 12/2008 Lown et al.
7,478,743 B2 1/2009 Holley, Jr.
7,604,157 B2 10/2009 Zammit et al.
7,699,215 B2 4/2010 Spivey, Sr.
7,780,067 B2 8/2010 Holley, Jr.
7,789,231 B2 * 9/2010 Requena ..... 206/427
7,913,844 B2 3/2011 Spivey, Sr.
8,061,587 B2 11/2011 Blin
8,070,052 B2 12/2011 Spivey, Sr.
8,459,534 B2 6/2013 Bradford
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2003/0006158 A1 1/2003 Skolik et al.
2003/0136820 A1 7/2003 Negelen
2003/0141313 A1 7/2003 Bates
2003/0150759 A1 8/2003 White, Jr.
2003/0192907 A1 10/2003 Bates
2004/0000494 A1 1/2004 Sutherland
2004/0040334 A1 3/2004 Rusnock
2004/0060972 A1 4/2004 Harrelson
2004/0089575 A1 5/2004 Lingamfelter
2004/0089671 A1 5/2004 Miller
2004/0099558 A1 5/2004 Oliff et al.
2004/0155098 A1 8/2004 Harrelson
2004/0164135 A1 8/2004 Gong et al.
2004/0188277 A1 9/2004 Auclair
2004/0188300 A1 9/2004 Sutherland
2004/0188508 A1 9/2004 Holley, Jr. et al.

(56) References Cited

U.S. PATENT DOCUMENTS

| | | | | |
|---|---|---|---|---|
| 2005/0023170 | A1 | 2/2005 | Lingamfelter | |
| 2005/0092820 | A1 | 5/2005 | Chekroune | |
| 2005/0115843 | A1 | 6/2005 | Harrelson | |
| 2005/0126947 | A1 | 6/2005 | Holley, Jr. | |
| 2005/0167291 | A1 | 8/2005 | Sutherland | |
| 2005/0167478 | A1 | 8/2005 | Holley, Jr. | |
| 2005/0189405 | A1 | 9/2005 | Gomes et al. | |
| 2005/0263574 | A1 | 12/2005 | Schuster | |
| 2006/0054522 | A1 | 3/2006 | Kline et al. | |
| 2006/0081691 | A1 | 4/2006 | Smalley | |
| 2006/0091193 | A1 | 5/2006 | DeBusk | |
| 2006/0118606 | A1 | 6/2006 | Holley, Jr. et al. | |
| 2006/0131370 | A1 | 6/2006 | Bates | |
| 2006/0175386 | A1 | 8/2006 | Holley, Jr. | |
| 2006/0231441 | A1 | 10/2006 | Gomes et al. | |
| 2006/0231600 | A1 | 10/2006 | Holley | |
| 2006/0249413 | A1 | 11/2006 | Auclair et al. | |
| 2006/0278689 | A1 | 12/2006 | Boshinski et al. | |
| 2007/0007325 | A1 | 1/2007 | Suzuki et al. | |
| 2007/0029371 | A1 | 2/2007 | Theelen | |
| 2007/0056869 | A1 | 3/2007 | Tokarski | |
| 2007/0108261 | A1 | 5/2007 | Schuster | |
| 2007/0131748 | A1 | 6/2007 | Brand | |
| 2007/0164093 | A1 | 7/2007 | Spivey et al. | |
| 2007/0181658 | A1 | 8/2007 | Sutherland | |
| 2007/0205255 | A1 | 9/2007 | Dunn | |
| 2007/0210144 | A1 | 9/2007 | Brand | |
| 2007/0215682 | A1 | 9/2007 | Bates et al. | |
| 2007/0251982 | A1 | 11/2007 | Brand | |
| 2007/0277481 | A1 | 12/2007 | LeBras | |
| 2007/0295790 | A1 | 12/2007 | Zammit et al. | |
| 2008/0023535 | A1 | 1/2008 | Holley, Jr. | |
| 2008/0048014 | A1 | 2/2008 | Bates | |
| 2008/0128479 | A1 | 6/2008 | Bates | |
| 2008/0257942 | A1* | 10/2008 | LeBras | 229/117.13 |
| 2009/0032425 | A1 | 2/2009 | Perkinson | |
| 2009/0065559 | A1 | 3/2009 | Parkes | |
| 2009/0236408 | A1 | 9/2009 | Spivey, Sr. et al. | |
| 2009/0282843 | A1 | 11/2009 | Brand | |
| 2010/0044420 | A1* | 2/2010 | Brand et al. | 229/117.13 |
| 2010/0122999 | A1 | 5/2010 | Brand | |
| 2010/0140336 | A1 | 6/2010 | Ho Fung | |
| 2010/0237138 | A1 | 9/2010 | Bradford | |
| 2011/0011924 | A1 | 1/2011 | Spivey et al. | |
| 2011/0049228 | A1 | 3/2011 | Brand | |
| 2011/0065558 | A1 | 3/2011 | Smalley | |
| 2011/0233091 | A1 | 9/2011 | Block et al. | |
| 2011/0284622 | A1 | 11/2011 | Boukredine | |
| 2011/0290692 | A1 | 12/2011 | Spivey, Sr. | |
| 2011/0290867 | A1 | 12/2011 | Schemmel et al. | |
| 2012/0279897 | A1 | 11/2012 | Schmal et al. | |
| 2013/0292285 | A1* | 11/2013 | Kastanek | 206/433 |
| 2014/0021071 | A1* | 1/2014 | Alexander et al. | 206/139 |
| 2014/0021080 | A1* | 1/2014 | Fitzwater et al. | 206/427 |
| 2014/0166519 | A1* | 6/2014 | Alexander | 206/427 |
| 2014/0260095 | A1* | 9/2014 | Oliveira | 53/410 |

FOREIGN PATENT DOCUMENTS

| | | | |
|---|---|---|---|
| EP | 0 066 029 | | 12/1982 |
| EP | 332 153 | B1 | 9/1991 |
| EP | 630 825 | A2 | 12/1994 |
| EP | 0 901 969 | B1 | 4/2000 |
| EP | 1 065 151 | A1 | 1/2001 |
| EP | 1 433 714 | | 6/2004 |
| EP | 1 103 481 | B1 | 8/2004 |
| EP | 1 010 637 | B1 | 9/2004 |
| EP | 1 125 858 | B1 | 9/2004 |
| EP | 1 381 545 61 | | 10/2005 |
| EP | 1 334 043 | B1 | 12/2005 |
| EP | 1 151 935 | B1 | 8/2006 |
| EP | 1 698 565 | | 9/2006 |
| EP | 1 513 737 | B1 | 11/2006 |
| EP | 2 055 648 | A1 | 5/2009 |
| EP | 1 749 755 | B1 | 12/2011 |
| FR | 2 549 010 | | 1/1985 |
| GB | 2 264 101 | | 8/1993 |
| JP | 11-124129 | A | 5/1999 |
| JP | 3039805 | | 3/2000 |
| JP | 2002-128064 | | 5/2002 |
| JP | 2004-059022 | A | 2/2004 |
| JP | 2006-111342 | | 4/2006 |
| JP | 2007-055630 | | 3/2007 |
| JP | 2007-204059 | A | 8/2007 |
| JP | 2007 0532421 | | 11/2007 |
| JP | 2008 213894 | A | 9/2008 |
| JP | 2009-120248 | | 6/2009 |
| JP | 2010-149927 | | 7/2010 |
| KR | 10-0154124 | | 2/1999 |
| KR | 10-0371048 | | 8/2003 |
| KR | 20-2010-0010124 | | 10/2010 |
| WO | WO 92/09498 | | 6/1992 |
| WO | WO 93/14991 | A1 | 8/1993 |
| WO | WO 95/08489 | A1 | 3/1995 |
| WO | WO 96/21603 | | 7/1996 |
| WO | WO 96/29260 | | 9/1996 |
| WO | WO 97/43191 | A1 | 11/1997 |
| WO | WO 99/28198 | | 6/1999 |
| WO | WO 99/64301 | | 12/1999 |
| WO | WO 00/03937 | | 1/2000 |
| WO | WO 02/47990 | | 6/2002 |
| WO | WO 2004/043790 | | 5/2004 |
| WO | WO 2005/042370 | A1 | 5/2005 |
| WO | WO 2005/051781 | | 6/2005 |
| WO | WO 2005/100175 | | 10/2005 |
| WO | WO 2006/050210 | | 5/2006 |
| WO | WO 2006/050316 | | 5/2006 |
| WO | WO 2007/076544 | | 7/2007 |
| WO | WO 2011/022145 | A1 | 2/2011 |
| WO | WO 2011/049947 | A1 | 4/2011 |

* cited by examiner

CARTON WITH ARTICLE PROTECTION FLAP

CROSS-REFERENCE TO RELATED APPLICATIONS

This application claims the benefit of U.S. Provisional Patent Application No. 61/741,315, filed Jul. 17, 2012. This application is related to U.S. patent application Ser. No. 13/419,740, filed Mar. 14, 2012, which claims the benefit of U.S. Provisional Application No. 61/518,504, filed May 6, 2011, U.S. Provisional Application No. 61/572,638, filed Jul. 19, 2011, U.S. Provisional Application No. 61/272,249, filed Oct. 7, 2011, U.S. Provisional Application No. 61/548,779, filed Oct. 19, 2011, and U.S. Provisional Application No. 61/570,044, filed Dec. 13, 2011.

INCORPORATION BY REFERENCE

The entire contents of U.S. Provisional Patent Application No. 61/741,315, filed Jul. 17, 2012, U.S. patent application Ser. No. 13/419,740, filed Mar. 14, 2012, U.S. Provisional Application No. 61/518,504, filed May 6, 2011, U.S. Provisional Application No. 61/572,638, filed Jul. 19, 2011, U.S. Provisional Application No. 61/272,249, filed Oct. 7, 2011, U.S. Provisional Application No. 61/548,779, filed Oct. 19, 2011, and U.S. Provisional Application No. 61/570,044, filed Dec. 13, 2011, are hereby incorporated by reference as if presented herein in their entirety.

BACKGROUND OF THE DISCLOSURE

The present disclosure generally relates to cartons for holding beverage containers or other types of articles. More specifically, the present disclosure relates to cartons having an article protection flap and access features for positioning the article protection flap.

SUMMARY OF THE DISCLOSURE

In general, one aspect of the disclosure is generally directed to a carton for containing at least one article. The carton comprises a plurality of panels at least partially forming an interior of the carton. The plurality of panels comprises a top panel. The carton comprises an article protection flap foldably connected to at least one panel of the plurality of panels. The article protection flap is moveable between a first position that is substantially parallel to the top panel and a second position wherein the article protection flap is folded relative to the top panel. The at least one access feature in the top panel is for positioning the article protection flap from the first position to the second position.

In another aspect, the disclosure is generally directed to a blank for forming a carton for containing at least one article. The blank comprises a plurality of panels for at least partially forming an interior of the carton. The plurality of panels comprising a top panel. An article protection flap is foldably connected to at least one panel of the plurality of panels. The article protection flap is for being moveable between a first position that is substantially parallel to the top panel and a second position wherein the article protection flap is folded relative to the top panel in the carton formed from the blank. At least one access feature is in the top panel for positioning the article protection flap from the first position to the second position in the carton formed from the blank In another aspect, the disclosure is generally directed to a method of forming a carton. The method comprising obtaining a blank comprising a plurality of panels comprising a top panel, and an article protection flap foldably connected to at least one panel of the plurality of panels. The top panel comprises at least one access feature. The method comprises positioning the plurality of panels to at least partially form an interior of the carton and loading at least one article in the interior of the carton. The method comprises accessing the article protection flap through the access feature and positioning the at least one article protection flap relative to the top panel after the loading the at least one article. The positioning comprises moving the article protection flap from a first position that is substantially parallel to the top panel to a second position wherein the article protection flap is folded relative to the top panel.

Other aspects, features, and details of the present disclosure can be more completely understood by reference to the following detailed description of exemplary embodiments taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to protection, opening, dispensing, and handling features for cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Some of the various features disclosed may be similar to any of the embodiments disclosed in the above-noted incorporated by reference patent applications, including U.S. patent application Ser. No. 13/419,740 and all related applications. Further, some of the various features disclosed herein may be combined with features disclosed in the '740 application to restrain movement of the containers in the carton.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
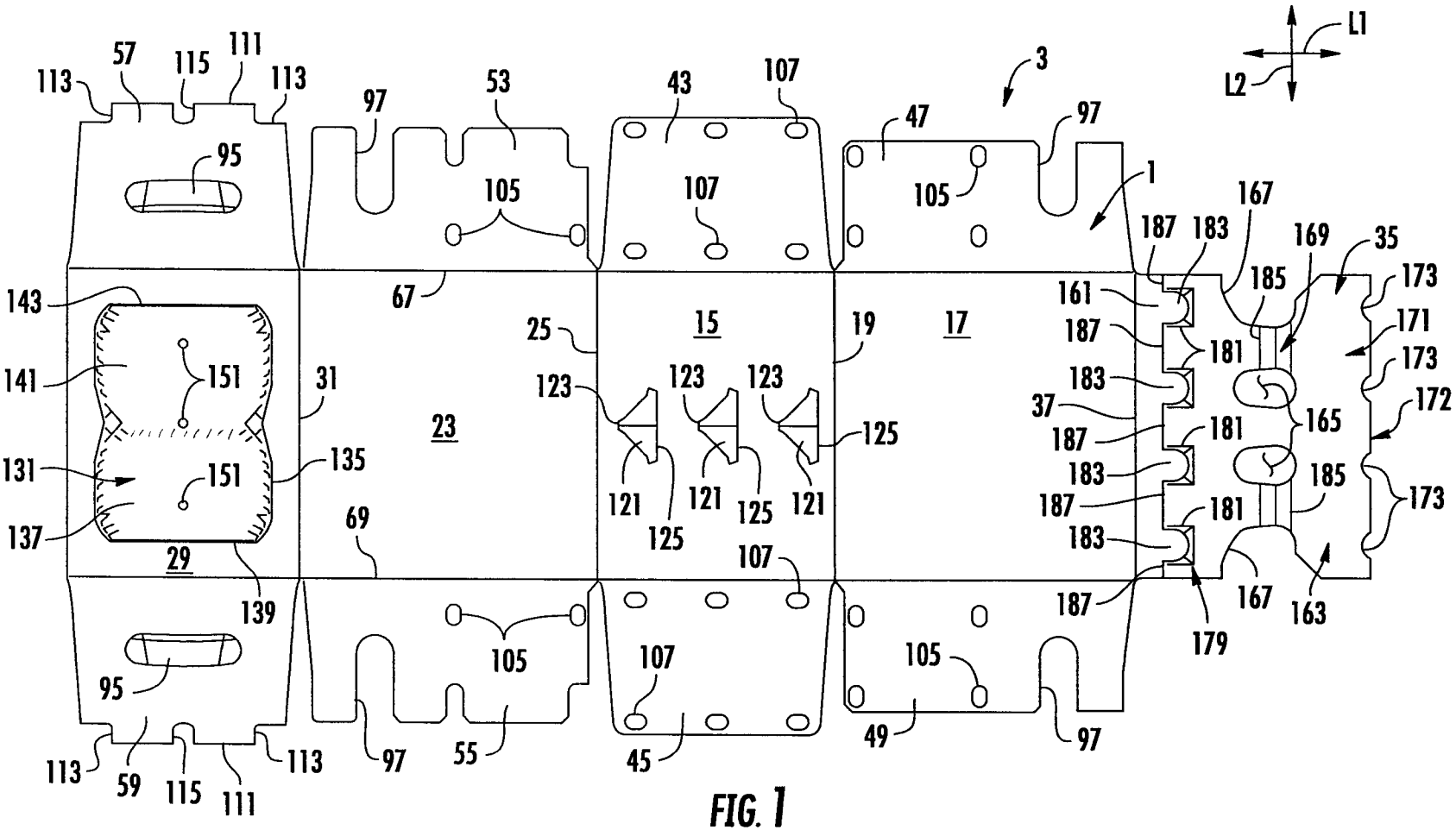
FIG. 1 is a plan view of an exterior surface of a blank according to a first exemplary embodiment of the disclosure.
Figure 3:
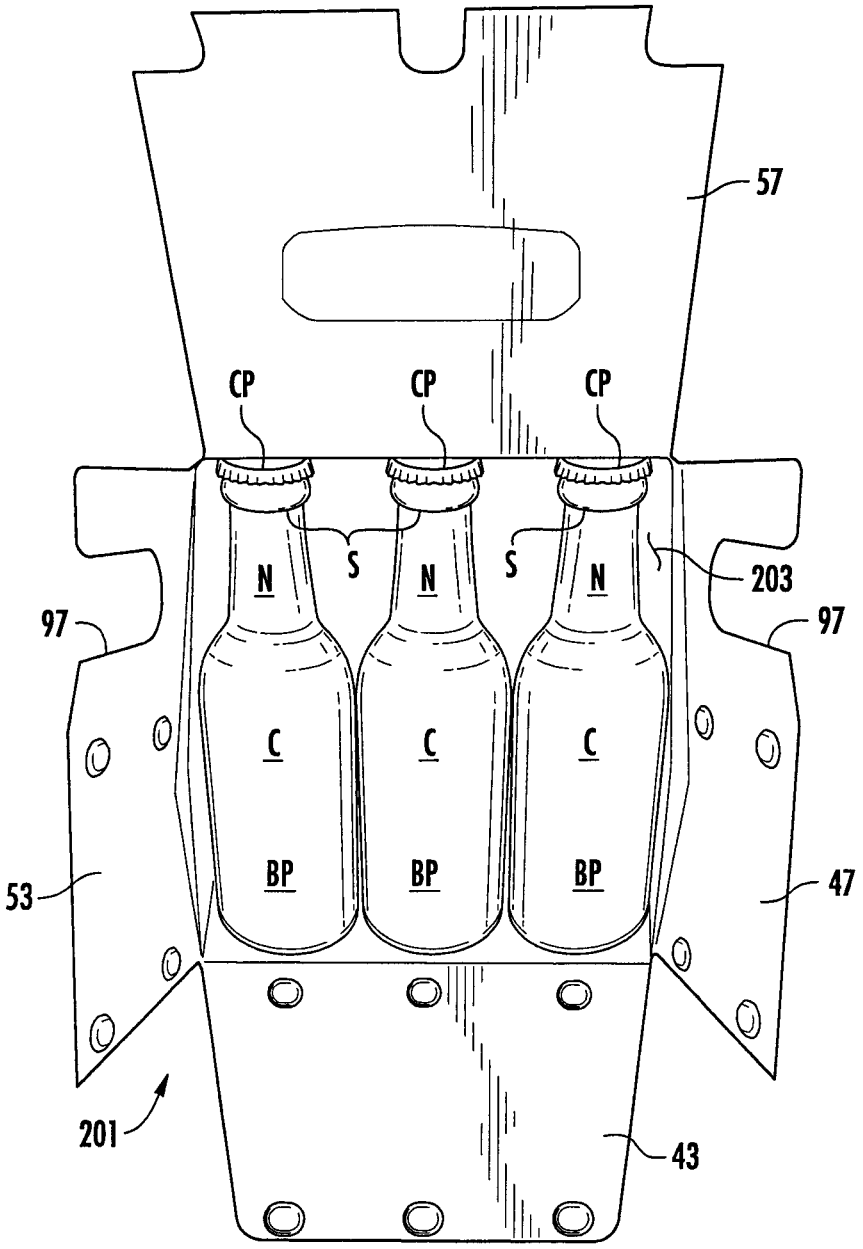
FIG. 3 is a perspective view of a partially assembled carton of FIG. 2 with articles loaded.
Figure 4:
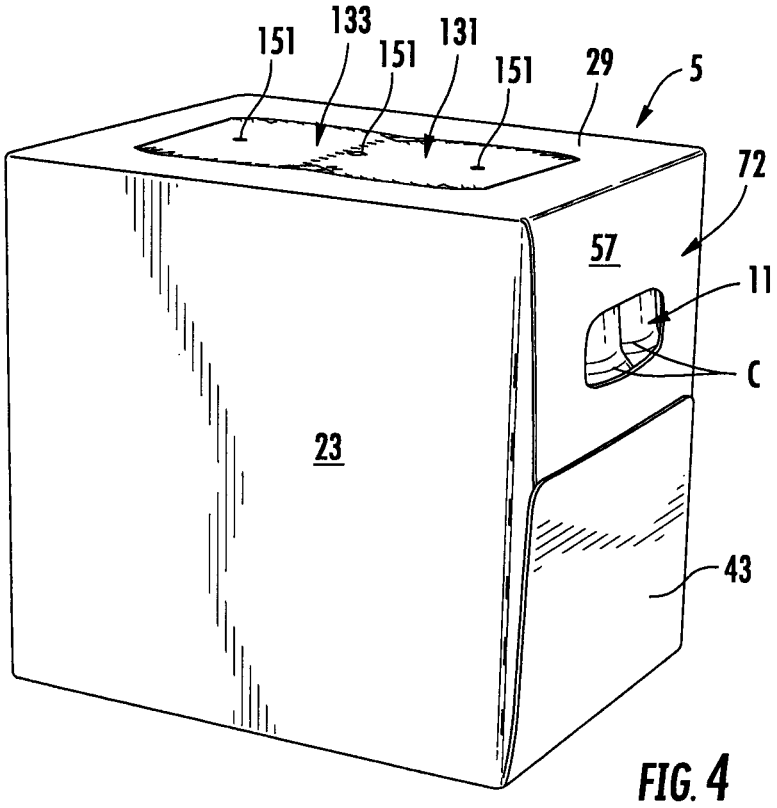
FIG. 4 is a side perspective view of the assembled carton.
Figure 5:
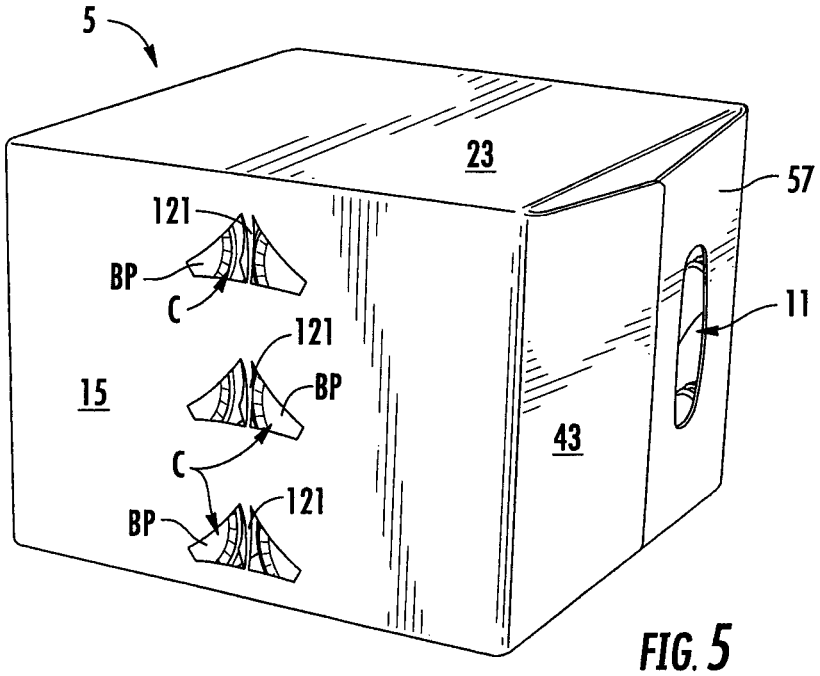
FIG. 5 is a bottom perspective view of the assembled carton.

FIG. 1 is a plan view of the exterior side 1 of a blank, generally indicated at 3, used to form a carton 5 (FIG. 4) according to a first exemplary embodiment of the disclosure. The carton 5 can be used to house a plurality of articles such as containers C (FIG. 3). In the illustrated embodiment, the containers C are bottles having a wide bottom portion BP, an upper portion or neck N extending upwardly from the bottom portion BP, a cap CP at the top of each container C, and a shoulder S just below the cap. In the illustrated embodiment, the carton 5 is sized to house twelve containers C in a single layer in a 3×4 arrangement, but it is understood that the carton 5 may be sized and shaped to hold containers C of a different or same quantity in more than one layer and/or in different row/column arrangements (e.g., 1×6, 3×6, 2×6, 2×6×2, 3×4×2, 2×9, 4×3, etc.). The containers C could be otherwise shaped, arranged, and/or configured without departing from the disclosure. For example, the containers C could be beverage cans or other containers. In the illustrated embodiment, the carton 5 includes a handle, generally indicated at 11 (FIGS. 4 and 5), for grasping and carrying the carton.

The blank 3 has a longitudinal axis L1 and a lateral axis L2. In the illustrated embodiment, the blank 3 comprises a bottom panel 15 foldably connected to a first side panel 17 at a first lateral fold line 19, a second side panel 23 foldably connected to the bottom panel 15 at a second lateral fold line 25, and a top panel 29 foldably connected to the second side panel 23 at a third lateral fold line 31. An article protection flap 35 is foldably connected to the first side panel 17 at a fourth lateral fold line 37. The article protection flap 35 could be foldably connected to one or more other panels (e.g., the top panel 29) without departing from the disclosure.

The bottom panel 15 is foldably connected to a first bottom end flap 43 and a second bottom end flap 45. The first side panel 17 is foldably connected to a first side end flap 47 and a second side end flap 49. The second side panel 23 is foldably connected to a first side end flap 53 and a second side end flap 55. The top panel 29 is foldably connected to a first top end flap 57 and a second top end flap 59. When the carton 5 is erected, the end flaps 43, 47, 53, 57 close a first end 72 of the carton, and the end flaps 45, 49, 55, 59 close a second end 74 of the carton. In accordance with an alternative embodiment of the present disclosure, different flap arrangements can be used for closing the ends of the carton 5.

The end flaps 43, 47, 53, 57 extend along a first marginal area of the blank 3, and are foldably connected at a first longitudinal fold line 67 that extends along the length of the blank. The end flaps 45, 49, 55, 59 extend along a second marginal area of the blank 3, and are foldably connected at a second longitudinal fold line 69 that also extends along the length of the blank. The longitudinal fold lines 67, 69 may be, for example, substantially straight, or offset at one or more locations to account for blank thickness or for other factors without departing from the scope of the disclosure.

As shown in FIG. 1, the blank 3 has handle features for forming a handle 11 at each end 72, 74 of the carton 5. The handle features include handle flaps 95 foldably connected to a respective top end flap 57, 59, and notches or openings 97 in the side end flaps 53, 55, 47, 49. The openings 97 cooperate to provide an opening at a respective closed end 72, 74 to allow a respective handle flap 95 to be inwardly folded so that the carton 5 can be grasped at a respective end. The blank 3 can have other features for forming the handle 11, or the blank and/or carton can have a handle that is alternatively shaped, arranged, and/or configured without departing from the disclosure. Further, the handle 11 can be omitted without departing from the disclosure.

In one embodiment, the blank 3 has features for forming article protection features in the ends 72, 74 of the carton 5. As shown in FIG. 1, the side end flaps 47, 49, 53, 55 have deformations in the form of indentations 105 on the exterior surface 1 of the blank 3 such that the indentations form a protrusion on the interior surface of the blank. The bottom end flaps 43, 45 each have two rows of deformations in the form of indentations 107 on the interior surface of the blank 3 such that the indentations on the interior surface form a protrusion on the exterior surface 1 of the blank 103. As shown in FIG. 1, the top end flaps 57, 59 each have a respective distal edge 111 having corner notches 113 and a center notch 115. The indentations 105, 107 can be any deformation on a surface of a respective side end flaps 47, 49, 53, 55 or bottom end flap 43, 45 such that the deformation can be any suitable shape (e.g., a concave depression or protrusion, convex depression or protrusion, flat depression or protrusion, embossed area, debossed area, etc., or any other suitable shape). Furthermore, the indentations 105, 107 could be formed on the interior or exterior surface of one or more of the first side panel 17, second side panel 23, top panel 29, bottom panel 15, or top end flaps 57, 59 without departing from the disclosure. The blank 3 can have other protection features that are alternatively shaped, arranged, and/or configured without departing from the disclosure. Further, the article protection features can be omitted without departing from the disclosure.

In the illustrated embodiment, the blank 3 includes three bottom article protection flaps 121 arranged in a 1×3 arrangement and foldably connected to the bottom panel 15, but the blank 3 could have more or less than three bottom article protection flaps 121, and the flaps 121 could be otherwise arranged in other suitable row/column arrangements or in a random configuration on the bottom panel 15, including a multiple row or a multiple column configuration, or any other suitable configuration. The bottom article protection flaps 121 are each foldably connected to the bottom panel 15 at a respective lateral fold line 123 and are each at least partially defined by a line of weakening 125 in the bottom panel 15. In one embodiment, the line of weakening 125 is a cut, but the line of weakening could comprises other forms of weakening (e.g., a tear line that comprises cut lines separated by breakable nicks, a tear line that is formed by a series of spaced apart cuts, etc.) that allows the bottom article protection flap 121 to separate from the bottom panel 15 without departing from the disclosure. In other embodiments, the blank 3 can include bottom article protection flaps 121 that are otherwise, shaped, arranged, and/or configured without departing from the disclosure. The bottom article protection flaps 121 could be omitted without departing from the disclosure.

In one embodiment, the blank 3 comprise a dispenser panel 131 in the top panel 29 for forming a dispenser 133 in the carton 5. The dispenser panel 131 is formed by a dispenser pattern or tear line 135 that extends in the top panel 29. In one embodiment, the dispenser panel 131 comprises a first portion 137 foldably connected to the top panel at a first longitudinal fold line 139 and a second portion 141 foldably connected to the top panel at a second longitudinal fold line 143. The first portion 137 and the second portion 141 are separable along a portion of the tear line 135 that is approximately in the middle of the top panel 29. The dispenser panel 131 could be otherwise shaped, arranged, and/or configured without departing from the disclosure. Further, the dispenser 133 and the dispenser panel 131 could be omitted without departing from the disclosure.

As shown in FIG. 1, the top panel 29 includes three access features 151 in the form of access flaps foldably connected to the top panel. The access flaps 151 are foldable to create an access opening 153 (FIGS. 6 and 7) in the top panel 29 for receiving a respective actuator or finger 155 of a carton forming machine 157 (partially shown in FIGS. 6 and 7). In one embodiment, the access features 151 are arranged in a single row on approximately the centerline of the top panel 29. Also, the access features 151 are provided in the dispenser panel 131. The access features 151 could be otherwise shaped, arranged, positioned, and/or configured without departing from the disclosure.

As shown in FIG. 1, the article protection flap 35 can include a base portion 161 foldably connected to the first side panel 17 at the fold line 37 and an article retention portion 163. The article retention portion 163 includes features for engaging the articles C that include two central openings 165 and two notches 167 in a middle portion 169 of the article protection flap. The article protection flap 35 includes a distal (broadly "first outer portion") 171 that has four notches 173 at a distal edge 172 of the article protection flap. The article protection flap 35 includes an article engaging portion 179 (broadly "second outer portion") adjacent the base portion 161 that includes article retention flaps 181 for engaging a portion of a respective article C. The base portion 161 includes four tabs 183 that contact the cap CP of a respective article of the row of articles that is adjacent the side panel 17. The retention flaps 181 of the article engaging portion 179 of the article retention flap 35 engage the underside of the cap CP or the shoulder S of a respective article of the row of articles that is adjacent the side panel 17. In the illustrate embodiment, the middle portion 169 of the article protection flap 35 includes fold lines 185 extending from an opening 165 to a respective notch 167. As shown in FIG. 1, the article retention portion 163 is connected to the base portion 161 by fold lines 187 adjacent to respective tabs 183. The article protection flap 35 could be otherwise shaped, arranged, and/or configured without departing from the disclosure.

Figure 2:
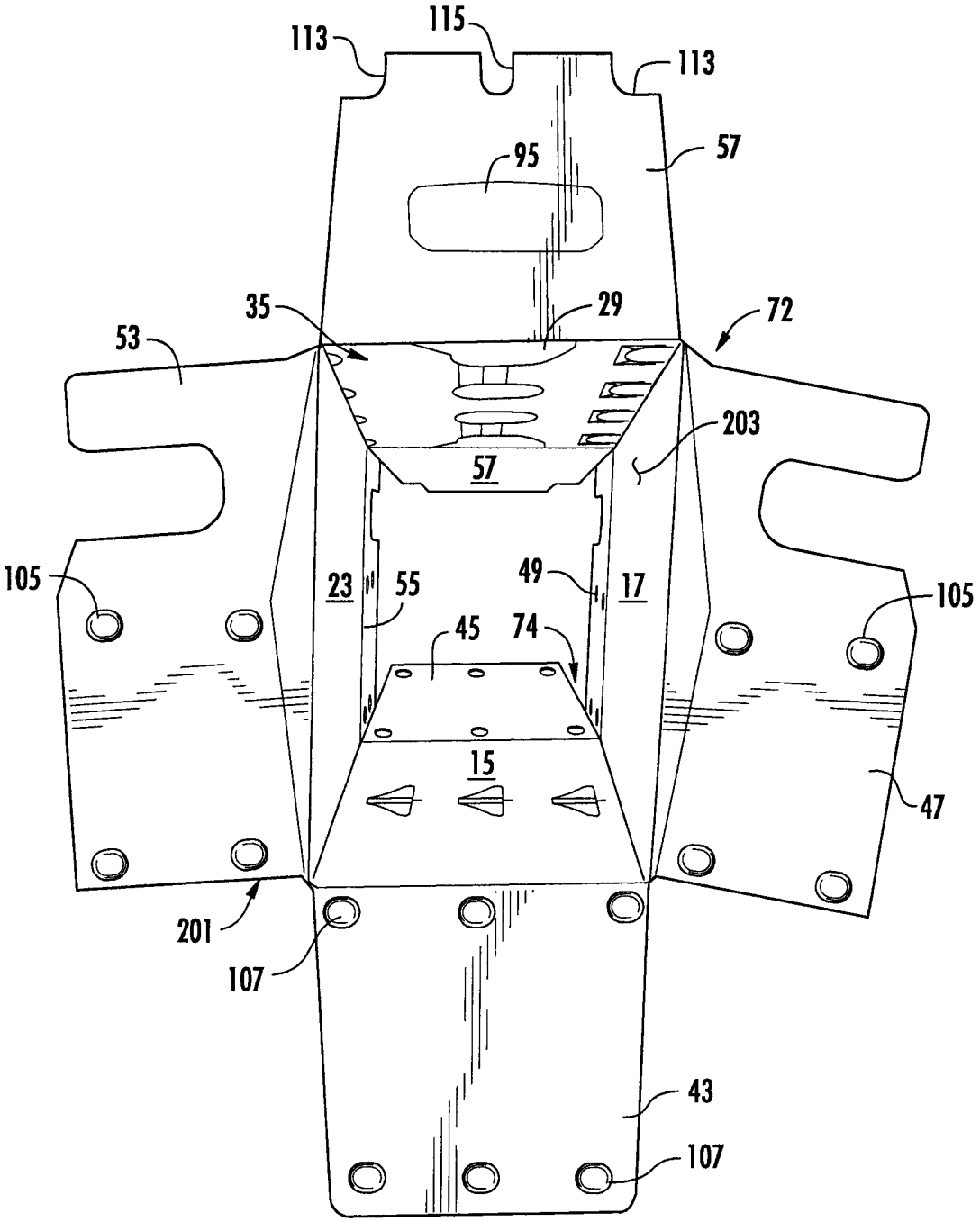
FIG. 2 is a perspective view of a partially assembled carton according to the exemplary embodiment of the disclosure.

In accordance with one exemplary embodiment, the blank 3 can be erected into the carton 5 by folding blank about fold lines 31 and 37 and positioning the article protection flap 35 to be in face-to-face contact with the interior surface of the top panel 29. The article protection flap can be secured to the top panel 29 by releasable adhesive such as glue or other suitable adhesive. Further, at various stages of the erecting process, glue or other adhesive can be applied to various portions of the blank 3. After attaching the article protection flap 35 to the top panel 29, the blank 3 can be formed into an open-ended sleeve 201 (FIG. 2) by folding the bottom panel 15, side panels 17, 23, and top panel 29 along respective fold lines 19, 25, 31, 37. Containers C can be loaded into an interior space 203 of the sleeve 201. One of the ends 72, 74 can be closed prior to loading the containers C or both of the ends can be closed after loading the containers into the interior space 203.

Figure 6:
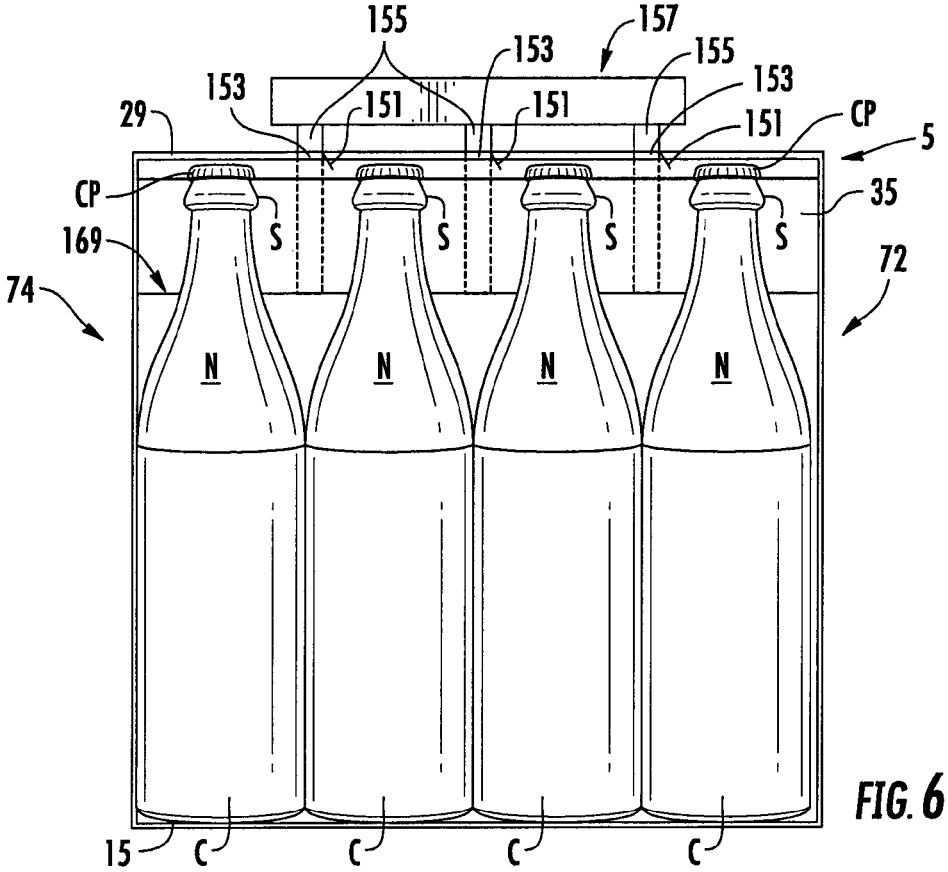
FIG. 6 is a side schematic view of the carton with a carton forming machine positioning an article protection flap.
Figure 7:
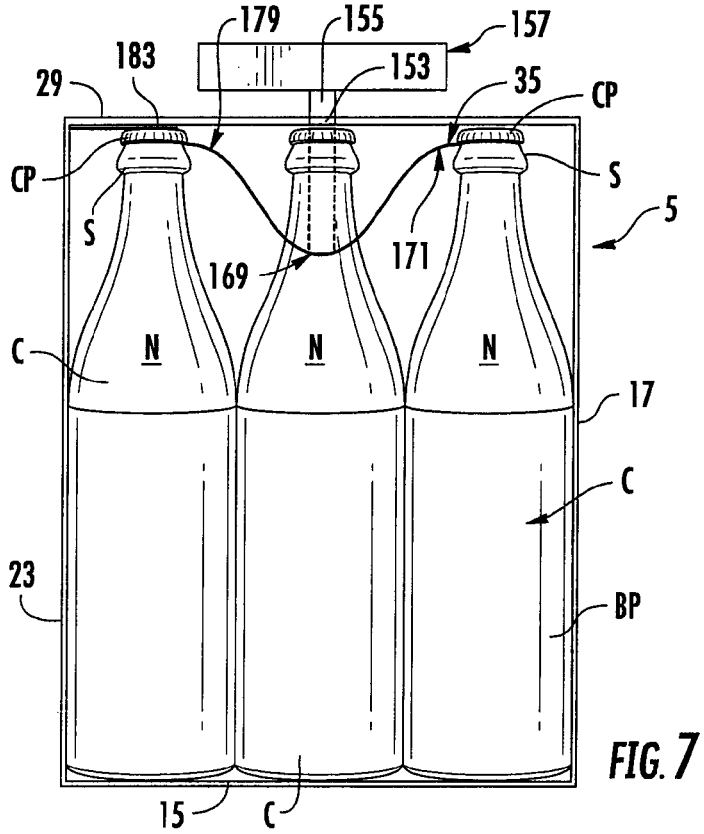
FIG. 7 is an end schematic view of the carton of FIG. 6.
Figure 8:
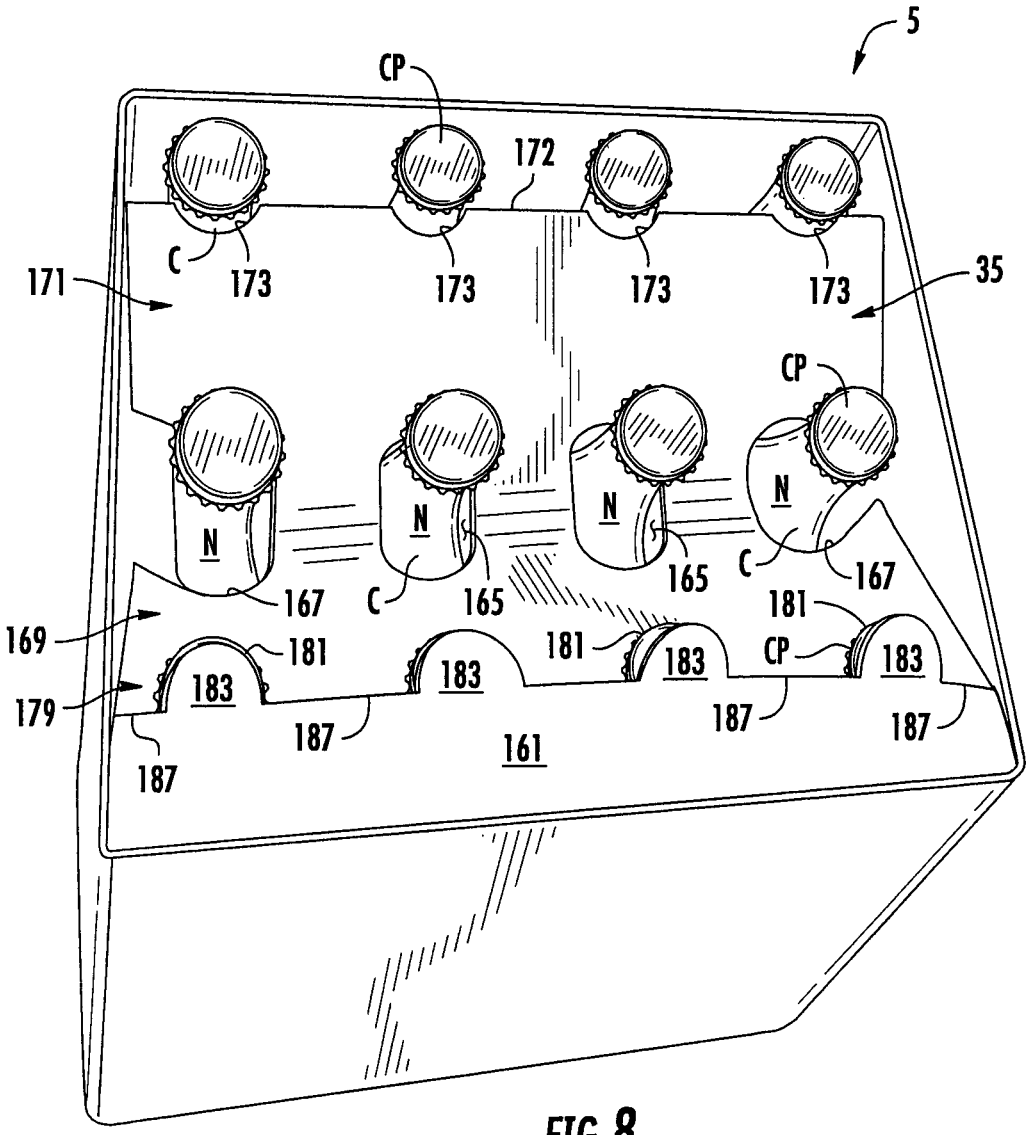
FIG. 8 is a top perspective of the assembled carton with a top panel removed to show the interior of the carton and the article protection flap.

After closing the ends 72, 74 (or alternatively, prior to closing the ends), the article protection flap 35 can be positioned to engage the articles C. As shown in FIGS. 6 and 7, a carton forming machine 157 having fingers or actuators 155 can be used to position the article protection flap 35 on the articles C. The actuators 155 of the carton forming machine 157 are inserted through the access features 151 in the top panel 29 to contact the article protection flap 35. In one embodiment, the carton forming machine 157 has three actuators 155 for contacting the middle portion 169 of the article protection flap 35, but the carton forming machine could have more or less than three actuators and could have actuators for contacting the two outer portions 171, 179 of the article protection flap 35. In the illustrated embodiment, the actuators 155 press down on the middle portion 169 of the article protection flap by way of the access openings 153 created in the top panel 29. When the article protection flap 35 is contacted by the actuators, the article protection flap breaks the adhesive bond with the top panel 29 and separates from the top panel such that the middle portion extends downwardly from the two outer portions 171, 179. The openings 165 and notches 167 receive a portion of a respective article in the middle row of articles. In one embodiment, the notches 173 in the distal portion 171 of the article protection flap 35 engage an underside of the caps CP of the row of articles C adjacent the second side panel 23, the article retention flaps 181 engage the underside of the caps CP of the row or articles adjacent the first side panel 17 and the tabs 183 contact the tops of the caps of the row of articles adjacent the first side panel 17. Alternatively, one or more of the notches 173 and article retention flaps 181 could engage an underside of the shoulder S of the respective articles in the carton, or one or more features could engage the neck N of the respective articles in the carton. The article protection flap 35 is positioned to engage a top portion of the articles C in the carton 5 to prevent or reduce the movement of the articles in the carton and to prevent or reduce breakage of the articles. The article protection flap 35 could be otherwise positioned in the carton 5 without departing from the disclosure.

In one embodiment, the loaded and closed carton 5 is further processed so that the bottom article protection flaps 121 are activated to provide a cushion between the bottom portion BP of the containers C inside the carton and further secure the containers to prevent breaking. The bottom article protection flaps 121 are foldably connected to the bottom panel 15 and moveable between a first position (that is substantially parallel to the bottom panel) and a second position wherein the bottom article protection flaps are folded upwardly relative to the bottom panel. In one embodiment, the bottom article protection flaps 121 are raised or activated and the bottom article protection flaps have features for preventing the folding of the article protection flaps from the second position back to the first position. It is understood that the bottom article protection flaps 121 will be activated to the second position (FIG. 5) after the ends 72, 74 of the carton 105 have been closed. Alternatively, the bottom article protection flaps 121 could be activated prior to closing one or both of the ends 72, 74 of the carton 5 without departing from the disclosure. In one embodiment, the bottom article protection flaps 121 are in contact with the bottom portion BP of the containers C, and the article protection flap 35 is in contact with the top portion (e.g., neck N, cap CP, or shoulder S) to prevent or reduce the movement of the articles C in the carton 5 and to prevent or reduce breakage of the articles.

FIGS. 9-12 illustrate various features of a blank 203 for forming a carton 205 of second embodiment having similar features as the first embodiment of the disclosure. Accordingly, similar or identical features of the embodiments are provided with like reference numbers. In the embodiment of FIGS. 9-12, the article protection flap 235 has a middle portion 209 comprising four openings 211 and two outer portions 213, 215 comprising four openings 217. The middle portion 209 includes two reinforcement flaps 221 at respective ends of the article retention flap for reinforcing the middle portion. The two interior openings 211 in the middle portion each comprise a respective article retention flap 227 adjacent a respective opening. The article protection flap 235 could be otherwise shaped, arranged, and/or configured without departing from the disclosure.

Figure 9:
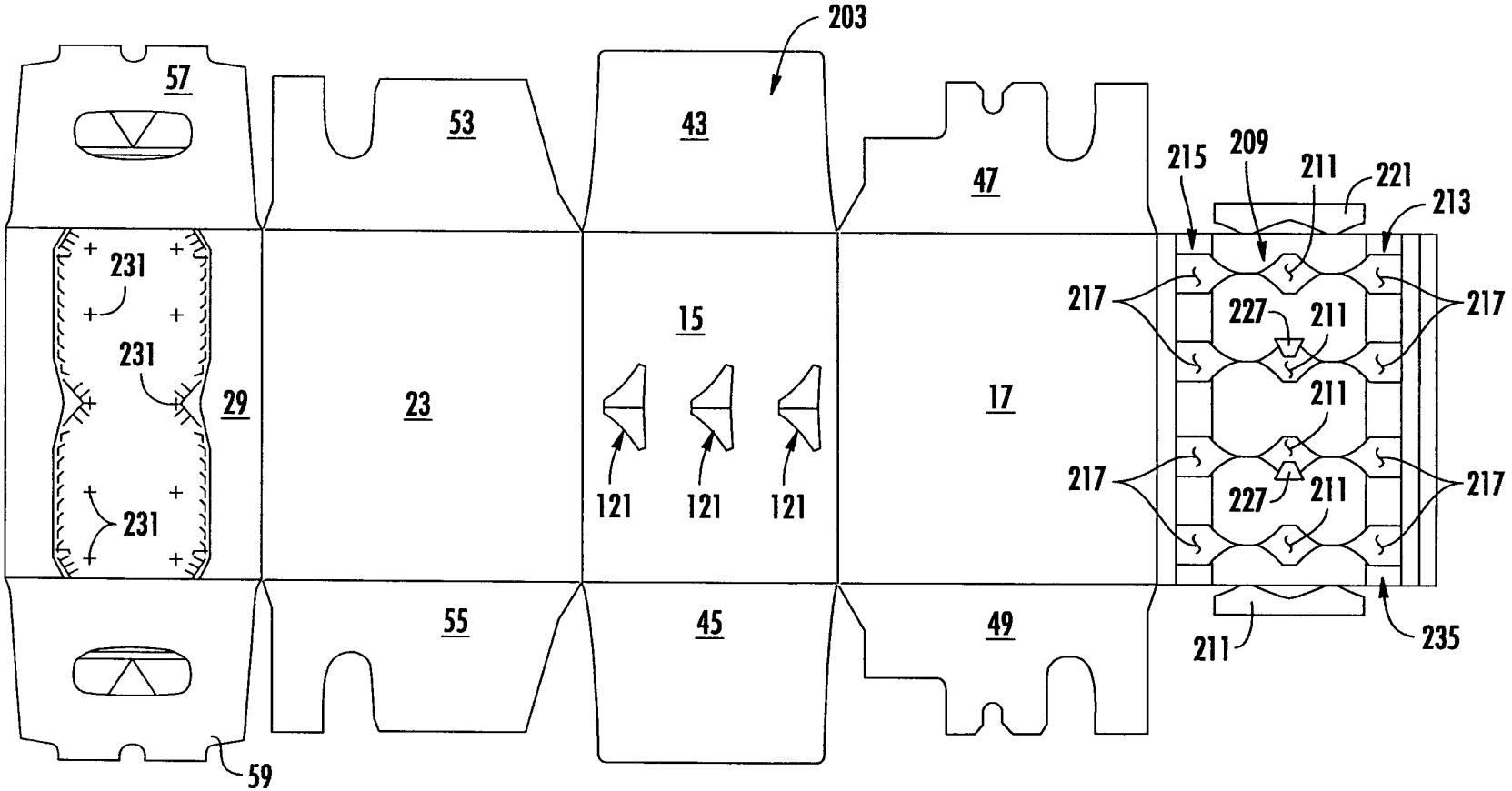
FIG. 9 is a plan view of an exterior surface of a blank according to a second exemplary embodiment of the disclosure.
Figure 10:
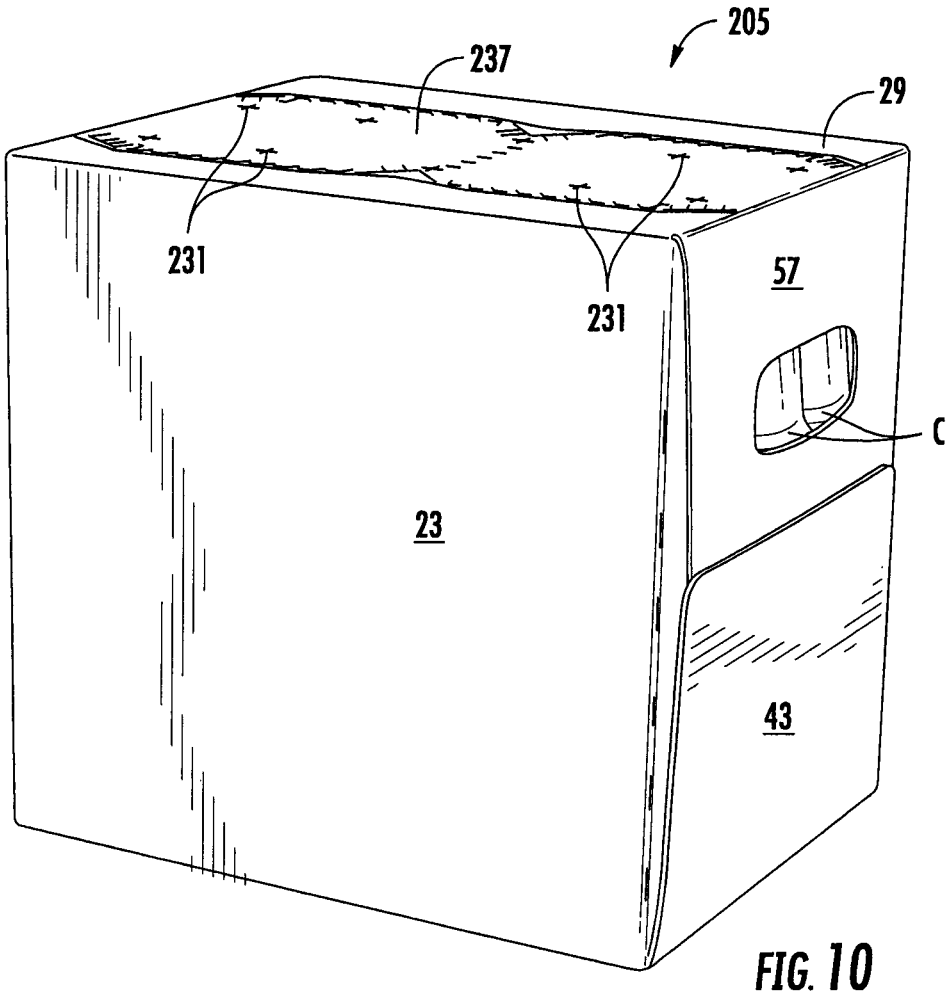
FIG. 10 is a perspective view of the assembled carton of the second embodiment.

As shown in FIG. 9, the top panel 29 includes twelve access openings 231 in the form of cuts in the top panel. The openings 231 are arranged in two rows of six cuts, but the openings could be otherwise shaped, arranged, and/or configured without departing from the disclosure. In the illustrated embodiment, the cuts 231 are located in the dispenser panel 237, but the cuts could be otherwise shaped, arranged, configured, and/or positioned without department from the disclosure.

Figure 11:
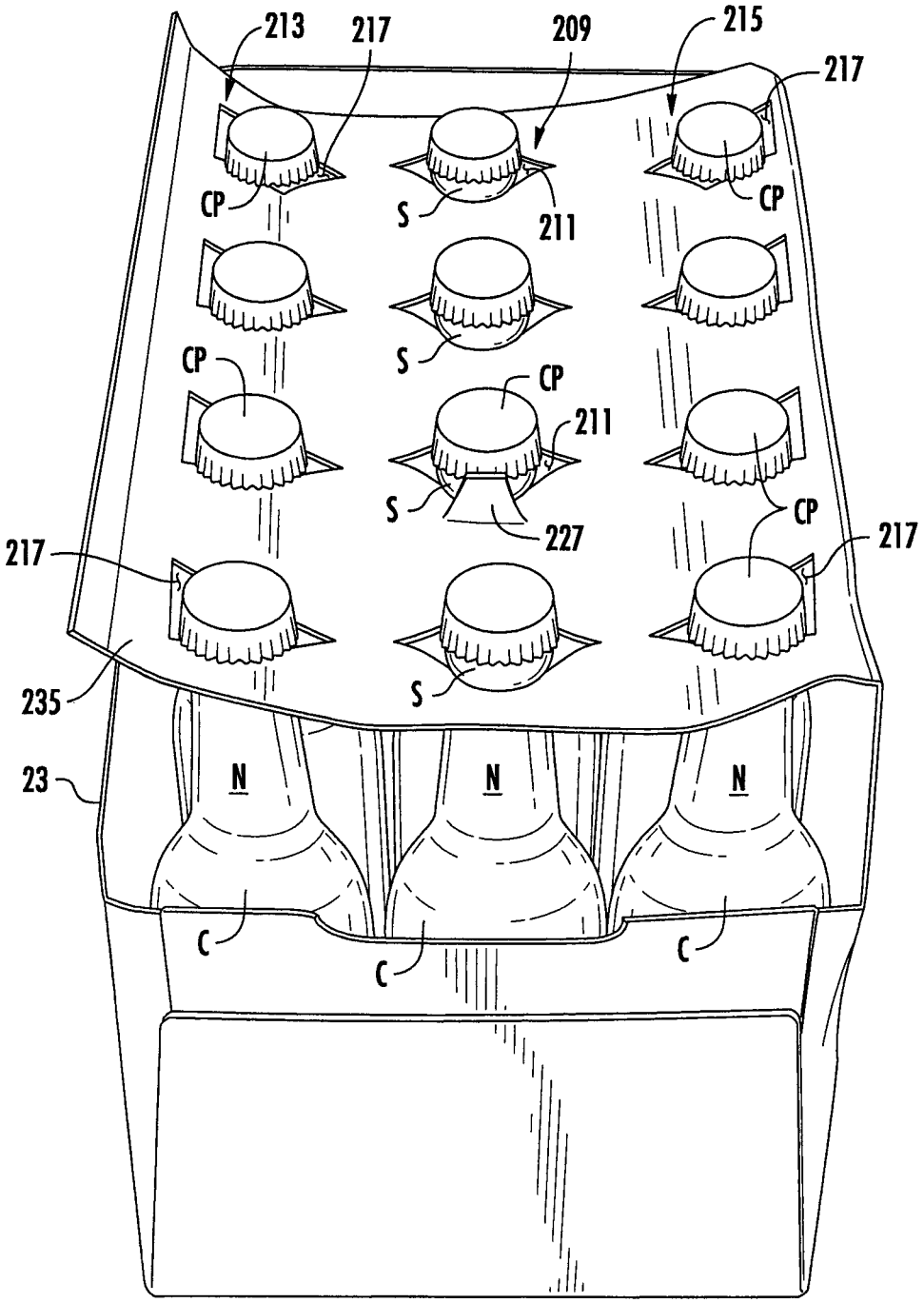
FIG. 11 is a top perspective view of the carton of FIG. 10 with the top panel removed to show the interior of the carton and the article protection flap.
Figure 12:
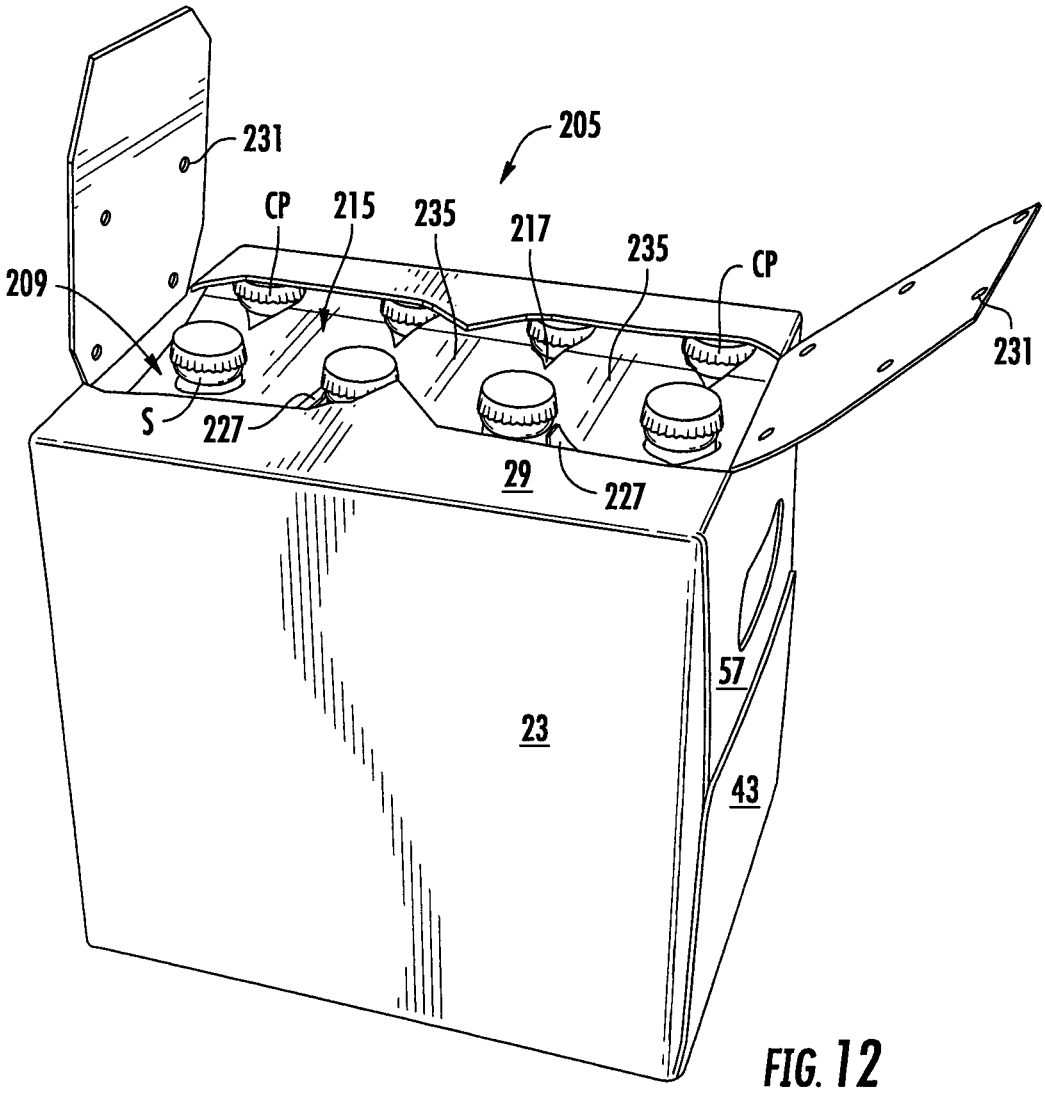
FIG. 12 is a perspective view of the carton of FIG. 10 in an opened configuration.

As shown in FIGS. 11 and 12, the article protection flap 235 can be positioned by the carton forming machine 157 to retain the articles C in a similar manner as the article retention flap 35 of the first embodiment. In one embodiment, the middle portion 209 of the article protection flap 235 can be pushed below the shoulders S of the articles C so that the shoulders engage the article retention flap adjacent the openings 211 in the middle portion. The article retention flaps 227 can be upwardly folded to engage the underside of a respective cap CP of a respective article C. The outer portions 213, 215 of the article protection flap 235 can be positioned so that the caps CP of respective articles in the two outer rows of articles engage the article protection flap adjacent respective openings 217 in the outer portions. Alternatively, one or both of the outer portions 213, 215 can be pressed downward so that the shoulders S of the two outer rows of articles engage the article protection flap 235 adjacent respective openings 217. The article protection flap 235 could be otherwise shaped, arranged, and/or configured without departing form the disclosure.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blanks. The blank can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising a plurality of panels at least partially forming an interior of the carton, the plurality of panels comprising a top panel;

an article protection flap foldably connected to at least one panel of the plurality of panels, the article protection flap is moveable between a first position that is substantially parallel to the top panel and a second position wherein the article protection flap is folded relative to the top panel; and at least one access feature in the top panel for positioning the article protection flap from the first position to the second position, the article protection flap comprises a base portion foldably connected to a panel of the plurality of panels and an article retention portion foldably connected to the base portion, the article retention portion comprises a plurality of features for engaging a respective article of the plurality of articles, the article protection flap has a middle portion extending downwardly from two outer portions, the middle portion comprises at least one of the plurality of features comprising an opening for engaging an article of the plurality of articles.

2. The carton of claim 1, wherein the plurality of features comprise a plurality of openings in the article retention portion for engaging a respective article of the plurality of articles.

3. The carton of claim 2, wherein the plurality of features comprises retention flaps for engaging a respective article of the plurality of articles.

4. The carton of claim 2, wherein the plurality of articles comprises containers having a cap and a shoulder, at least one of the plurality of features being in contact with one of the cap and the shoulder.

5. The carton of claim 4, wherein the article retention features in the middle portion contact a portion of the articles below the shoulder, article retention features in the two outer portions contact the cap of the articles to restrain movement of the containers in the carton.

6. The carton of claim 4, wherein the article retention features in the middle portion contact the shoulder and the article retention features in the outer portions contact the cap of the plurality of containers.

7. The carton of claim 2, wherein the at least one of the plurality of features comprises notches in a free edge of at least one of the two outer portions of the article protection flap.

8. The carton of claim 1, wherein the base portion comprises at least one tab for engaging a top of the at least one article.

9. The carton of claim 8, wherein the article retention portion comprises retention flaps adjacent the at least one tab for engaging a portion of the at least one article.

10. The carton of claim 1, wherein the access feature comprises a plurality of access flaps foldably connected to the top panel, the plurality of access flaps are foldable to create a respective access opening in the top panel.

11. The carton of claim 1, wherein the plurality of panels comprises a bottom panel, the article protection flap is a top article protection flap, and the carton further comprising at least one bottom article protection flap foldably connected to the bottom panel, the bottom article protection flap is moveable between a first position that is substantially parallel to the bottom panel and a second position wherein the bottom article protection flap is folded relative to the bottom panel, the bottom article protection flap has features for preventing folding of the article protection flap from the second position to the first position.

12. The carton of claim 11, wherein the bottom article protection flap is for contact with a bottom portion of the at least one article and the top article protection flap is for contact with a top portion of the at least one article.

13. The carton of claim 1, wherein the article protection flap comprises a first free edge, a second free edge, and a third free edge, each of the first free edge, the second free edge and third free edge comprise at least one notch.

14. The carton of claim 1, wherein the two outer portions are a first outer portion and a second outer portion, the middle portion is foldably connected to the first outer portion at a first fold line and foldably connected to the second outer portion at a second fold line, and the first outer portion is foldably connected to the base portion at least partially along a third fold line.

15. A blank for forming a carton for containing a plurality of articles, the blank comprising:

a plurality of panels for at least partially forming an interior of the carton, the plurality of panels comprising a top panel;

an article protection flap foldably connected to at least one panel of the plurality of panels, the article protection flap is for being moveable between a first position that is substantially parallel to the top panel and a second position wherein the article protection flap is folded relative to the top panel in the carton formed from the blank; and at least one access feature in the top panel for positioning the article protection flap from the first position to the second position in the carton formed from the blank, and the article protection flap comprises a base portion foldably connected to a panel of the plurality of panels and an article retention portion foldably connected to the base portion, the article retention portion comprises a plurality of features for engaging a respective article of the plurality of articles, the article protection flap has a middle portion that is for extending downwardly from two outer portions in the carton formed from the blank, the middle portion comprises at least one of the plurality of features comprising an opening for engaging an article of the plurality of articles in the carton formed from the blank.

16. The blank of claim 15, wherein the plurality of features comprises a plurality of openings in the article retention portion for engaging a respective article of the plurality of articles.

17. The blank of claim 16, wherein the plurality of features comprises retention flaps for engaging a respective article of the plurality of articles.

18. The blank of claim 16, wherein the at least one of the plurality of features comprises notches in a free edge of the article protection flap in at least one of the outer portions.

19. The blank of claim 15, wherein the base portion comprises at least one tab for engaging a top of the at least one article, and the retention portion comprises retention flaps adjacent the at least one tab for engaging a portion of the at least one article.

20. The blank of claim 15, wherein the access feature comprises a plurality of access flaps foldably connected to the top panel, the plurality of access flaps are foldable to create a respective access opening in the top panel.

21. The blank of claim 15, wherein the plurality of panels comprises a bottom panel, the article protection flap is a top article protection flap, and the carton further comprising at least one bottom article protection flap foldably connected to the bottom panel, the bottom article protection flap is moveable between a first position that is substantially parallel to the bottom panel and a second position wherein the bottom article protection flap is folded relative to the bottom panel in the carton formed from the blank, the bottom article protection flap has features for preventing folding of the article protection flap from the second position to the first position.

22. The blank of claim 21, wherein the bottom article protection flap is for contact with a bottom portion of the at least one article and the top article protection flap is for contact with a top portion of the at least one article in the carton formed from the blank.

23. A method of forming a carton, the method comprising:

obtaining a blank comprising a plurality of panels comprising a top panel, an article protection flap foldably connected to at least one panel of the plurality of panels, and the top panel comprises at least one access feature, the article protection flap comprises a base portion foldably connected to a panel of the plurality of panels and an article retention portion foldably connected to the base portion, the article retention portion comprises a plurality of features for engaging a respective article of the plurality of articles, the article protection flap has a middle portion and two outer portions, the middle portion comprises at least one of the plurality of features comprising an opening for engaging an article of the plurality of articles;

positioning the plurality of panels to at least partially form an interior of the carton;

loading a plurality of articles in the interior of the carton;

accessing the article protection flap through the access feature and positioning the at least one article protection flap relative to the top panel after the loading plurality of articles, the positioning comprises moving the article protection flap from a first position that is substantially parallel to the top panel to a second position wherein the article protection flap is folded relative to the top panel, the positioning comprises positioning the middle portion to extend downwardly from the two outer portions and placing the opening in the middle portion in engagement with an article of the plurality of articles.

24. The method of claim 23, wherein the engaging comprises operating a carton forming machine having at least one actuator, the at least one actuator being inserted through the access feature and contacting the article retention portion to position the article retention portion in contact with at least one article of the plurality of articles.

25. The method of claim 24, wherein the base portion comprises at least one tab and the positioning comprises contacting the at least one tab with a top of the at least one article.

26. The method of claim 25, wherein the retention portion comprises retention flaps adjacent the at least one tab and the positioning comprises contacting the retention flaps with a portion of the at least one article.

27. The method of claim 24, wherein the access feature comprises a plurality of access flaps foldably connected to the top panel, the engaging comprises folding the plurality of flaps to create a respective access opening in the top panel and inserting a respective finger of the carton forming machine through a respective opening.

28. The method of claim 24, wherein the at least one feature is a plurality of features, the plurality of features comprise a plurality of openings in the article retention portion, the engaging comprises inserting a respective one of the articles through a respective one of the openings.

29. The method of claim 28, wherein the plurality of features comprises retention flaps and the engaging comprises contacting the retention flaps with a respective article of the plurality of articles.

30. The method of claim 28, wherein the plurality of articles comprises containers having a cap and a shoulder.

31. The method of claim 30, wherein the openings are in the middle portion and the middle portion contacts a portion of the articles below the shoulder, the two outer portions have article retention features that contact the cap of the articles to restrain movement of the containers in the carton.

32. The method of claim 31, wherein the article retention features comprise notches in a free edge of the article protection flap in at least one of the two outer portions.

33. The method of claim 28, wherein the plurality of articles comprises containers having a cap and a shoulder, the article retention features in the middle portion contact the shoulder and the article retention features in the outer portions contact the cap of the plurality of containers.

34. The method of claim 33, wherein the plurality of panels comprises a bottom panel, the article protection flap is a top article protection flap, and the carton further comprising at least one bottom article protection flap foldably connected to the bottom panel, the method comprises positioning the bottom article protection flap between a first position that is substantially parallel to the bottom panel and a second position wherein the bottom article protection flap is folded relative to the bottom panel, the bottom article protection flap has features for preventing folding of the article protection flap from the second position to the first position.

35. The method of claim 34, wherein the positioning the bottom article protection flap comprises contacting the bottom article protection flap with a bottom portion of the at least one article and positioning the top article protection flap comprises contacting the top article protection flap with a top portion of the at least one article.

* * * * *